US008459348B2

(12) United States Patent
Mineo et al.

(10) Patent No.: US 8,459,348 B2
(45) Date of Patent: Jun. 11, 2013

(54) DOWNHOLE LINE TOOL ASSEMBLY AND METHOD FOR USE THEREOF

(75) Inventors: Richard Mineo, Richardson, TX (US); Jerry Clinton Foster, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/539,672

(22) Filed: Jul. 2, 2012

(65) Prior Publication Data

US 2013/0025885 A1 Jan. 31, 2013

(30) Foreign Application Priority Data

Jul. 27, 2011 (WO) ..... PCT/US2011/045504

(51) Int. Cl.
*E21B 17/10* (2006.01)

(52) U.S. Cl.
USPC ..... 166/241.5; 166/385

(58) Field of Classification Search
USPC ..... 166/385, 241.1, 241.5
See application file for complete search history.

(56) References Cited

U.S. PATENT DOCUMENTS

| | | | | |
|---|---|---|---|---|
| 3,036,522 | A * | 5/1962 | Lindsey | 166/54.6 |
| 6,076,603 | A * | 6/2000 | Perrin | 166/304 |
| 6,086,353 | A * | 7/2000 | Klaus | 425/145 |
| 2005/0056427 | A1 | 3/2005 | Clemens et al. | |
| 2005/0263325 | A1 | 12/2005 | Doering et al. | |
| 2009/0045975 | A1 * | 2/2009 | Evans et al. | 340/855.5 |
| 2009/0159269 | A1 * | 6/2009 | Sheiretov et al. | 166/216 |
| 2010/0170675 | A1 | 7/2010 | Daigle et al. | |
| 2010/0258293 | A1 | 10/2010 | Lynde et al. | |

OTHER PUBLICATIONS

ISR & WO; PCT/US2011/045504; KIPO; Feb. 28, 2012.

* cited by examiner

*Primary Examiner* — David Bagnell
*Assistant Examiner* — Ronald Runyan
(74) *Attorney, Agent, or Firm* — Lawrence R. Youst

(57) ABSTRACT

A downhole line tool assembly (200) for use in a wellbore. The downhole line tool assembly (200) includes a downhole power unit (206) having a moveable shaft (240) and a line motivator tool (208) having a drive assembly (246, 247) adapted to contact a line (204) passing through the line motivator tool (200) in the wellbore. The drive assembly (246, 247) is operably associated with the moveable shaft (240) such that rotation of the moveable shaft (240) rotates the drive assembly (246, 247), thereby moving the line (204) relative to the line motivator tool (208).

18 Claims, 6 Drawing Sheets

DOWNHOLE LINE TOOL ASSEMBLY AND METHOD FOR USE THEREOF

CROSS-REFERENCE TO RELATED APPLICATIONS

This application claims the benefit under 35 U.S.C. §119 of the filing date of International Application No. PCT/US2011/045504, filed Jul. 27, 2011. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole line tool assembly capable of performing various operations in conjunction with line deployed in a wellbore.

BACKGROUND OF THE INVENTION

Various types of tools may be deployed and operated in a wellbore in conjunction with drilling, completion and production operations. Many such tools may be deployed, retrieved or operated using a nonelectric cable known as a slickline, which may be a single round strand of wire or a multi-strand braided line. In certain operations, it may be desirable to deploy or operate a device in a wellbore that already contains a line. For example, after a downhole tool has been deployed into a wellbore using a slickline, it may be desirable to deploy a second downhole tool to perform an operation in the wellbore before the slickline is retrieved or in the event the first downhole tool or the slickline become stuck in the wellbore. It has been found, however, that current systems fail to effectively utilize previously-deployed line within a wellbore as a means to propel a device through the wellbore. In fact, current devices are generally unable to travel downhole at all while the wellbore contains a line.

In addition, it has been found, that use of slickline to deploy, retrieve or operate downhole tools is difficult in certain wellbores having unfavorable characteristics, such as slanted wells, deviated wells, lateral wells, horizontal wells and wells having restrictions. Specifically, due to the lack of gravity available to propel the tool and/or the slickline downhole, operations in such wellbores typically require other conveyance systems such as wireline, coiled tubing, jointed tubing or the like. These conveyance systems, however, typically involve more surface equipment and set up time and are generally more costly to operate.

Accordingly, a need has arisen for improved systems and methods of deploying, retrieving or operating downhole tools in a wellbore using slickline. In addition, a need has arisen for improved systems and methods of using slickline in wellbores having unfavorable characteristics.

SUMMARY OF THE INVENTION

The present invention disclosed herein is directed to improved systems and methods of deploying, retrieving and operating downhole tools in wellbores having a line positioned therein. In addition, the present invention is directed to improved systems and methods of using line in wellbores having unfavorable characteristics.

In one aspect, the present invention is directed to a downhole line tool assembly for use in a wellbore. The downhole line tool assembly includes a downhole power unit having a moveable shaft and a line motivator tool having a drive assembly adapted to contact a line passing through the line motivator tool in the wellbore. The drive assembly is operably associated with the moveable shaft such that rotation of the moveable shaft rotates the drive assembly, thereby moving the line relative to the line motivator tool.

In one embodiment, the downhole line tool assembly is operable to move along the line through the wellbore when the drive assembly moves the line relative to the line motivator tool. In this embodiment, rotation of the moveable shaft in a first direction moves the line motivator tool uphole and rotation of the moveable shaft in a second direction moves the line motivator tool downhole. In certain embodiments, a first downhole tool may be operably associated with at least one of the downhole power unit and the line motivator tool. In these embodiments, the first downhole tool may be a line cutter or a paraffin scraper, for example, or may include a communication module operable to wirelessly or connectably communicate with a second downhole tool.

In one embodiment, the line may be a slickline. In some embodiments, the line motivator tool may include a housing having first and second apertures and defining an internal cavity. In such embodiments, the line is moveable through the first aperture, the second aperture and the internal cavity. In certain embodiments, the drive assembly may include first and second drive rollers operable to receive the line therebetween. In some embodiments, the drive assembly may include a drive shaft and a gearbox operably associated with the moveable shaft.

In another embodiment the downhole line tool assembly may include an anchor assembly operably associated with at least one of the downhole power unit and the line motivator tool. The anchor assembly is extendable radially outward from the downhole line tool assembly to contact a surface within the wellbore to secure the downhole line tool assembly at a target location within the wellbore. In such embodiments, rotation of the moveable shaft in a first direction moves the line uphole and rotation of the moveable shaft in a second direction moves the line downhole when the downhole line tool assembly is secured at the target location.

In some embodiments, the downhole power unit includes a self-contained power source for providing electrical power. Also, the downhole power unit may include an electric motor having a rotor and a jackscrew assembly having a rotational member connected to the rotor. The rotational member is operably associated with the moveable shaft to impart motion to the moveable shaft.

In another aspect, the present invention is directed to a method for operating a downhole line tool assembly in a wellbore. The method includes providing a downhole line tool assembly including a downhole power unit having a moveable shaft and a line motivator tool having a drive assembly adapted to contact a line passing through the line motivator tool in the wellbore; operably associating the drive assembly with the moveable shaft such that rotation of the moveable shaft rotates the drive assembly; and responsive to rotation of the drive assembly, moving the line relative to the line motivator tool.

The method may also include moving the line motivator tool uphole responsive to rotation of the moveable shaft in a first direction and moving the line motivator tool downhole responsive to rotation of the moveable shaft in a second direction. Alternatively or additionally, the method may include anchoring the downhole line tool assembly in the wellbore, moving the line uphole responsive to rotation of the moveable shaft in a first direction and moving the line downhole responsive to rotation of the moveable shaft in a second direction. Further, the method may include providing a downhole tool operably associated with at least one of the downhole power unit and the line motivator tool, rotating the moveable shaft to position the downhole line tool assembly at a target location within the wellbore and activating the downhole tool to perform an operation within the wellbore.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
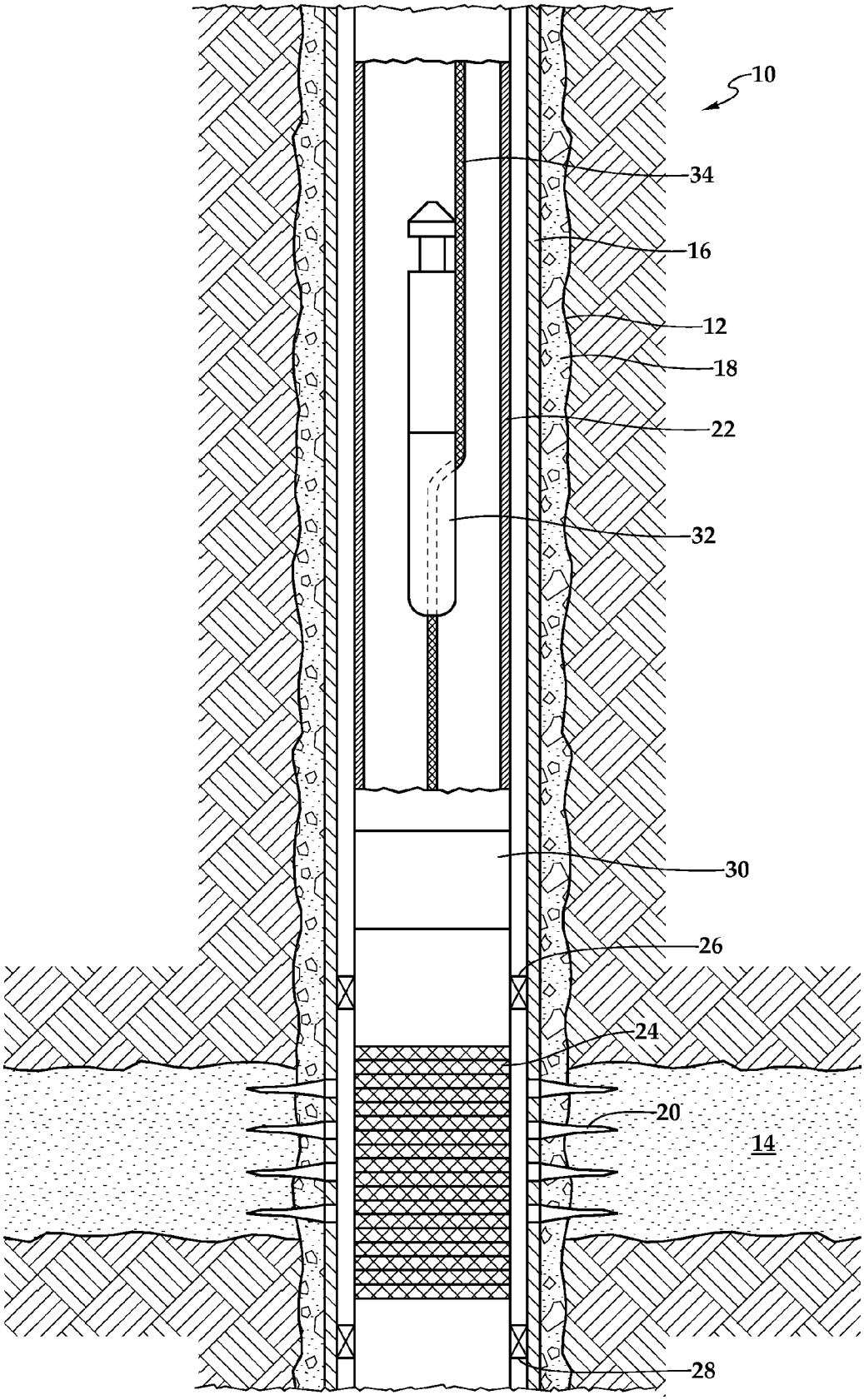
FIG. 1 is a schematic illustration of a well system including a downhole line tool assembly according to an embodiment of the present invention.

Referring initially to FIG. 1, therein is depicted a well system including a downhole line tool assembly embodying principles of the present invention that is schematically illustrated and generally designated 10. In the illustrated embodiment, a wellbore 12 extends through the various earth strata including a hydrocarbon bearing subterranean formation 14. Wellbore 12 has casing string 16 secured therein by cement 18. Communication between the interior of casing string 16 and formation 14 has been established via a plurality of perforations 20.

Positioned within wellbore 12 and extending from the surface is a tubing string 22. Tubing string 22 provides a conduit for formation fluids to travel from formation 14 to the surface and injection fluids to travel from the surface to formation 14. In a completion interval, tubing string 22 includes a sand control screen 24 positioned between a pair of packers 26, 28 that provides a fluid seal between tubing string 22 and casing string 16. Tubing string 22 also includes a flow control device 30 such as a choke or a valve. Disposed within tubing string 22 is a downhole line tool assembly 32 that is being deployed down a line 34 extending from the surface to the completion interval. In the illustrated embodiment, downhole line tool assembly 32 utilizes line 34 as a means to propel itself through wellbore 12.

Line 34 may be run into, or otherwise used in, wellbore 12 for a wide variety of purposes, such as, deploying tools downhole, retrieving tools uphole, actuating downhole tools positioned in the wellbore such as flow control device 30, enabling communication with downhole tools or the like. As used herein, the term line preferably refers to slickline but may also refer to wireline, electric line, composite line, cable or other conveyance line or the like. Line 34 may be a single round strand of wire or a multi-strand braided line and may or may not have the capability communicating power, signals or data. Line 34 may be rigid or flexible, depending upon the application. Unless otherwise indicated, as used herein, "or" does not require mutual exclusivity.

Figure 2:
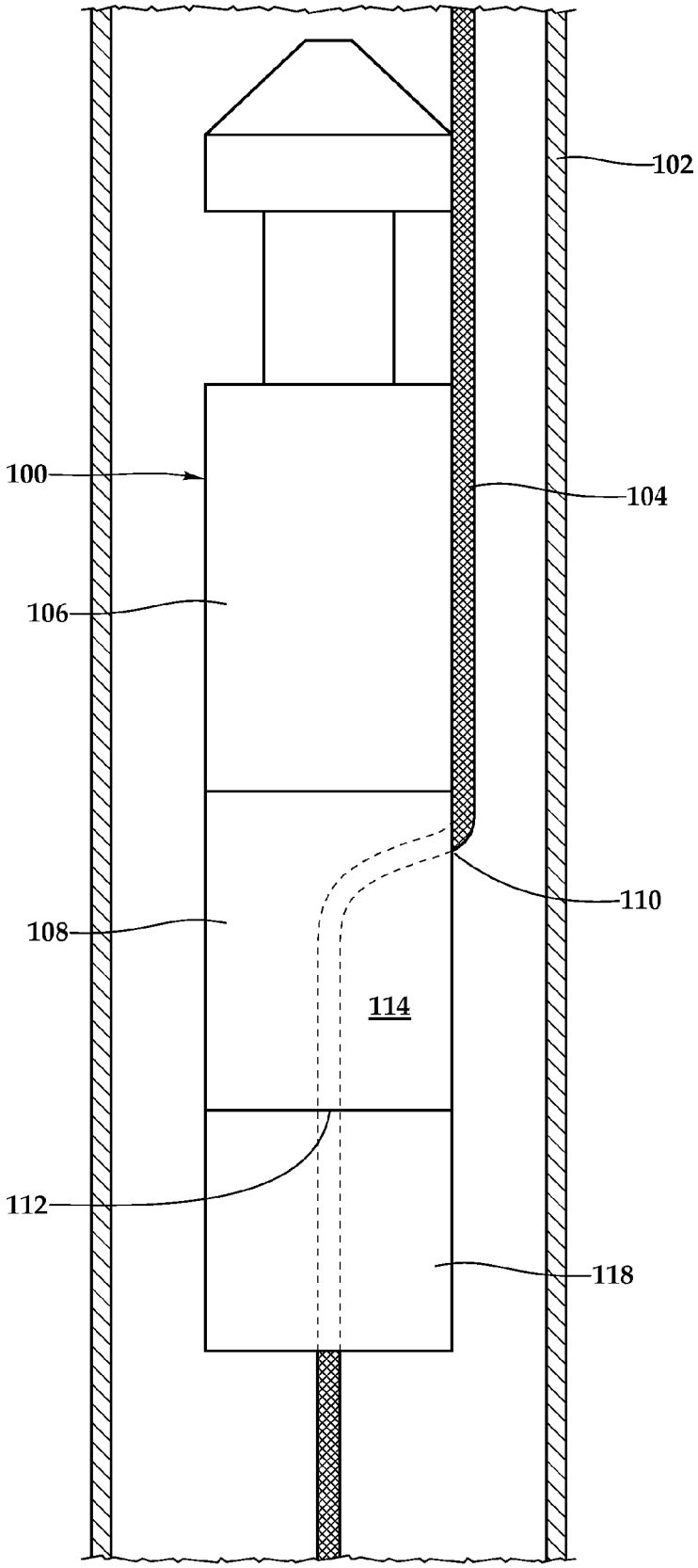
FIG. 2 is a schematic diagram of a downhole line tool assembly deployed in a wellbore according to an embodiment of the present invention.

Referring now to FIG. 2, therein is depicted a more detailed view of a downhole line tool assembly that is generally designed 100. Downhole line tool assembly 100 is depicted within tubing string 102 that is positioned in a wellbore as described above. Downhole line tool assembly 100 is utilizing a line 104 as a means to propel itself through the wellbore. In the illustrated embodiment, downhole line tool assembly 100 includes a downhole power unit 106, which provides power or mechanical energy to a line motivator tool 108. Line motivator tool 108 may move line 104 relative to downhole line tool assembly 100 to propel downhole line tool assembly 100 in either direction along line 104, thereby shuttling downhole line tool assembly 100 through the wellbore along line 104. Additionally or alternatively, as described below, downhole tool line assembly 100 may include one or more anchors that secure downhole line tool assembly 100 at a target location within the wellbore so that downhole line tool assembly 100 may push, pull or otherwise motivate line 104 downhole or uphole through the wellbore.

As will be described in further detail below, line motivator tool 108 contains a drive assembly that grips or otherwise contacts line 104 such that operation of the drive assembly causes movement of line 104 relative to line motivator tool 108. In this manner, line motivator tool 108 uses line 104 as a track or path along which to propel downhole line tool assembly 100 in either direction through the wellbore in a manner that is independent of tubing string 102 or other wellbore systems. During operation, line 104 enters and exits line motivator tool 108 via one or more apertures 110, 112, and may additionally pass through an internal cavity 114 formed by an outer housing of line motivator tool 108. Even though FIG. 2 depicts line 104 passing through the interior of line motivator tool 108 and the exterior of downhole power unit 106, it should be understood by those skilled in the art that line 104 could alternatively pass through both line motivator tool 108 and downhole power unit 106.

Downhole power unit 106 may be any device capable of converting electrical energy into mechanical energy. In one embodiment, downhole power unit 106 includes a self-contained power source that provides electrical power, such as one or more batteries, which is then converted into mechanical energy by downhole power unit 106. In another embodiment, power may also be supplied to downhole power unit 106 using an umbilical cord or electric line from the surface of the well. As will be described in more detail below, in one embodiment, downhole power unit 106 may include an elongated housing, a motor disposed in the housing and a sleeve connected to a rotor of the motor. The sleeve may be a rotational member that rotates with the rotor. A moveable member such as a moveable shaft may be received within the threaded interior of the sleeve. Operation of the motor rotates the sleeve which causes the moveable shaft to rotate.

In an illustrative embodiment, a microcontroller made of suitable electrical components to provide miniaturization and durability within the high pressure, high temperature environments that can be encountered in an oil or gas well may be used to control the operation of downhole power unit 106. The microcontroller may be housed within the structure of downhole power unit 106; it can, however, be connected outside of downhole power unit 106 but within an associated tool string moved into the wellbore. In whatever physical location the microcontroller is disposed, it may be operationally connected to downhole power unit 106 to control movement of the moveable member, such as the moveable shaft, when desired. In one embodiment, the microcontroller includes a microprocessor which operates under control of a timing device and a program stored in a memory. The program in the memory may include instructions which cause the microprocessor to control downhole power unit 106.

The microcontroller may operate using power from the power supply of downhole power unit 106. When it is desired to operate downhole line tool assembly 100, the microcontroller may commence operation of downhole power unit 106, as programmed. For example, with regard to controlling the motor that operates the sleeve receiving the moveable shaft, the microcontroller may send a command to energize the motor to rotate the sleeve in the desired direction to rotate the moveable shaft in the desired direction. One or more sensors may monitor the operation of downhole power unit 106 and provide responsive signals to the microcontroller. When the microcontroller determines that a desired result has been obtained, it may stop operation of downhole power unit 106, such as by de-energizing the motor.

In the illustrated embodiment, in addition to shuttling through the wellbore using the line motivator tool 108, downhole line tool assembly 100 may include a downhole tool 118 capable of performing an operation in the wellbore. Downhole tool 118 may be operably associated with either or both of downhole power unit 106 and line motivator tool 108.

As used herein, the term "operably associated" shall encompass direct coupling such as via a threaded connection, a pinned connection, a frictional connection, a closely received relationship or the like and may also include the use of set screws or other securing means. The term "operably associated" may also encompass two or more components that are continuous with one another by virtue of each of the components being formed from the same piece of material. In addition, the term "operably associated" shall encompass indirect coupling such as via a connection sub, an adaptor or any other intermediate component or coupling means. The term "operably associated" also encompasses mechanical or electrical relationships in which two or more objects are moveable relative to one another, including when a first object imparts force or motion to a second object. One non-limiting example of such a mechanical moveable relationship occurs when two or more objects are directly or indirectly coupled via one or more gears or interlocking teeth, such that movement of one of the objects imparts force or motion on another one of the objects.

Any type of downhole tool 118 capable of performing an operation or function in the wellbore may be included with downhole line tool assembly 100. In one embodiment, downhole tool 118 may be a line cutter that cuts line 104 on command. In this embodiment, the line cutter may include one or more blades, saws or other components capable of cutting line 104, which may differ depending on the type of line being cut. To illustrate an example usage of the line cutter, downhole line tool assembly 100 may be shuttled along line 104 down wellbore 102 until it reaches a target location within wellbore 102 such that the liner cutter is proximate to a rope socket of a tool on the end of line 104. Upon reaching the target location, line motivator tool 108 may be deactivated such that downhole line tool assembly 100 is no longer moving along line 104. The line cutter may then be activated and draw upon power from downhole power unit 106 or another source so that it may cut line 104 at the target location. Downhole line tool assembly 100 may then be shuttled back up to the surface along line 104.

In another embodiment, downhole tool 118 may be a paraffin scraper for removing paraffin or soft wax deposits from tubular string 102. In this embodiment, downhole line tool assembly 100 may be activated and shuttled along line 104 down to a target location within the wellbore at which it is desired to scratch or remove paraffin from tubular string 102. Upon reaching this target location, downhole line tool assembly 100 may be deactivated from further movement and the paraffin scraper may be activated, using power from downhole power unit 106 or from another source. Downhole line tool assembly 100 may then be reactivated for movement along line 104 to enable the paraffin scraper to perform the paraffin scraping operation. Thereafter, if desired, downhole line tool assembly 100 may be shuttled to another target location within the wellbore for additional paraffin scraping operations or may be shuttled back to the surface along line 104.

In another embodiment, downhole tool 118 may be a communication module that is capable of communication with a previously installed downhole tool and a command/control center at the surface. In one example of this embodiment, downhole line tool assembly 100 may be used to shuttle data between the previously installed downhole tool and the surface. For example, the communication module may be used to interrogate one or more sensors that collect data within the wellbore. The data is downloaded onto the communication module and may be stored on a storage device in the communication module, or elsewhere within downhole line tool assembly 100. In another embodiment, data may be provided from a storage device within downhole line tool assembly 100 to the previously installed downhole tool for usage by that tool.

Data may be exchanged between the previously installed downhole tool and the communication module in a variety of ways. For example, data may be communicated wirelessly or through inductive coupling. In another embodiment, the communication module may be physically connected to the previously installed downhole tool such as through a wetmate connection using, for example, male and female adapters, which enable data communication therebetween. Other wired or wireless techniques for data telemetry may alternatively be used and are considered within the scope of the present invention. After the desired communication exchange has taken place between the previously installed downhole tool and the communication module, downhole line tool assembly 100 may be shuttled back up to the surface along line 104, or used in another downhole operation.

In another embodiment, downhole line tool assembly 100 may be used to transport power or energy through the wellbore to another device, such as to a previously installed downhole tool. This power or energy may be provided by downhole power unit 106, or another device included with downhole line tool assembly 100.

Figure 3A:
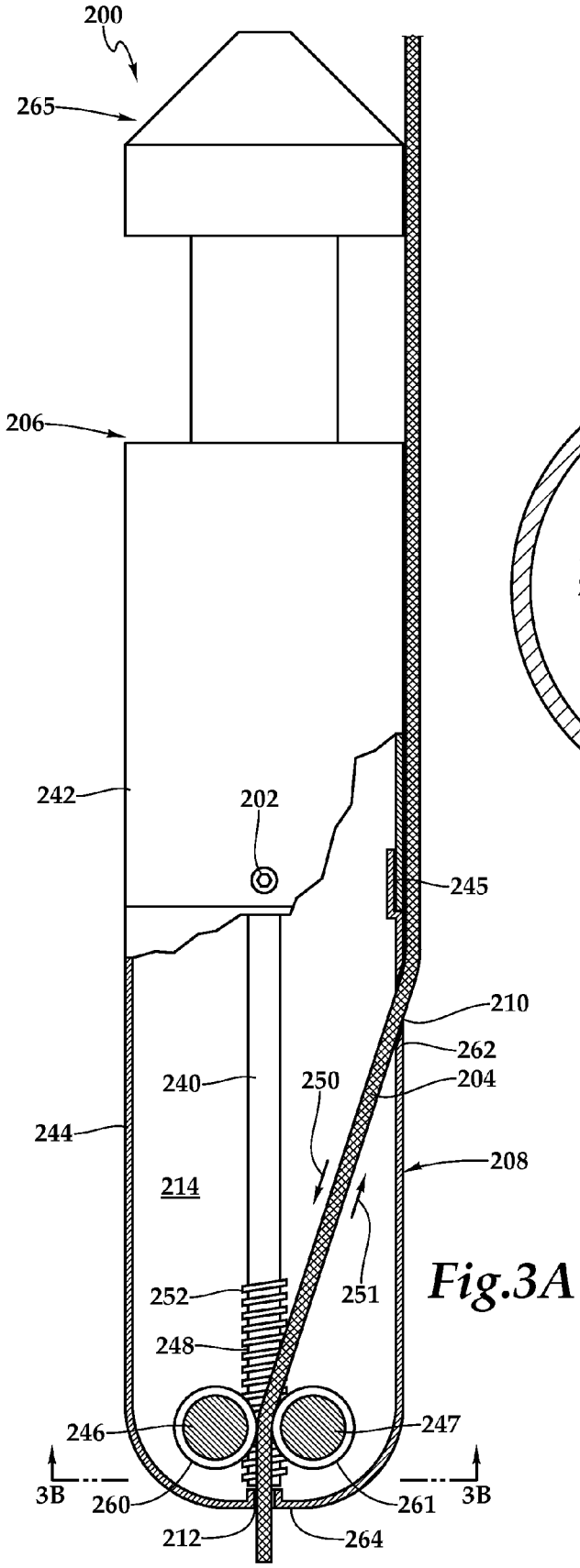
FIG. 3A is a schematic plan view, in partial cross section, of a downhole line tool assembly according to an embodiment of the present invention.
Figure 3B:
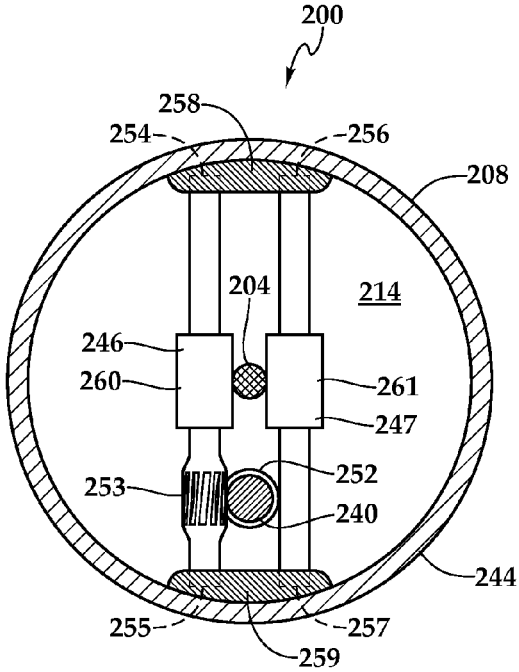
FIG. 3B is a schematic cross-sectional view of the downhole line tool assembly of FIG. 3A taken along line 3B-3B.

Referring next to FIGS. 3A and 3B, an illustrative embodiment of a downhole line tool assembly is generally designated 200. Downhole line tool assembly 200 includes downhole power unit 206 that rotates moveable shaft 240 that extends into internal cavity 214 of line motivator tool 208. Downhole power unit 206 has a power unit housing 242 and line motivator tool 208 has a line motivator tool housing 244. In the illustrated embodiment, power unit housing 242 and line motivator tool housing 244 are coupled together at joint 245 with one or more set screws 202. In other embodiments, power unit housing 242 may be coupled to line motivator tool housing 244 using alternate means or power unit housing 242 and line motivator tool housing 244 may otherwise be operably associated with one another.

Moveable shaft 240, which is rotatable in either direction by downhole power unit 206, may extend into line motivator tool 208 and be operably associated with a drive assembly of line motivator tool 208 depicted as including a pair of drive rollers 246, 247. In one embodiment, a downhole end 248 of moveable shaft 240 is operably associated with drive rollers 246, 247. While the drive assembly of line motivator tool 208 may include a pair of drive rollers 246, 247 as depicted in FIGS. 3A and 3B, it should be understood by those skilled in the art that the drive assembly could have other numbers of drive rollers or be formed from other components so long as operation of the drive assembly motivates line 204 to move relative to line motivator tool 208. As illustrated, drive rollers 246, 247 contact or grip line 204 so that when either or both of the drive rollers 246, 247 are rotated, line 204 will move relative to line motivator tool 208.

Moveable shaft 240 is operably associated with drive rollers 246, 247 such that when moveable shaft 240 is rotated by downhole power unit 206, either or both of the drive rollers 246, 247 rotate to move line 204 through internal cavity 214 of line motivator tool 208. By motivating line 204 in either direction relative to line motivator tool 208, downhole line tool assembly 200 may move in either direction through the wellbore, as described in FIGS. 1 and 2.

Also, line 204 may be moveable in either direction 250, 251 relative to line motivator tool 208 depending on the direction that moveable shaft 240 rotates. For example, if moveable shaft 240 rotates in a first direction, drive rollers 246, 247 may rotate so as to move line 204 in the direction indicated by arrow 250 such that downhole line tool assembly 200 moves uphole. Conversely, moveable shaft 240 may rotate in a second, opposite direction to cause drive rollers 246, 247 to rotate and move line 204 in the direction indicated by arrow 251, thereby moving downhole line tool assembly 200 downhole. The direction of the rotation of moveable shaft 240 may be controlled, as described above, so that the movement of downhole line tool assembly 200 in either the uphole or downhole direction may be controlled.

The operable association between moveable shaft 240 and drive rollers 246, 247 may include any direct or indirect coupling that allows the rotation of moveable shaft 240 to impart force, or rotation, upon drive rollers 246, 247. In the non-limiting example of FIGS. 3A and 3B, the downhole end 248 of moveable shaft 240 may include one or more teeth or threads in a spiral pattern 252 that wraps around the outer surface of the downhole portion 248 of moveable shaft 240. Spiral pattern 252 may act as a worm gear and interlock with one or more teeth 253 on either or both of the drive rollers 246, 247. In the non-limiting example of FIGS. 3A and 3B, teeth 253 are located on drive roller 246. As moveable shaft 240 rotates in either direction, spiral pattern 252 interacts with teeth 253 on drive roller 246 such that drive roller 246 is motivated to rotate which in turn moves line 204 in either direction 250 or direction 251.

Drive roller 247 may also contain one or more teeth, such as teeth 253, such that drive roller 247 is also motivated to rotate in response to the rotation of moveable shaft 240. In other embodiments, moveable shaft 240 may be operably associated with either or both of the drive rollers 246, 247 or other components of the drive assembly in other ways including any mechanical, electrical or magnetic relationships and the like.

In one illustrative embodiment, drive rollers 246, 247 laterally extend across internal cavity 214 of the line motivator tool 208. The ends 254, 255, 256, 257 of drive rollers 246, 247, respectively, may be operably associated with bearings 258, 259 such that drive rollers 246, 247 are allowed to freely rotate. As illustrated, drive rollers 246, 247 may be partially or fully surrounded by a gripping material 260, 261 that may enhance the grip of drive rollers 246, 247 on line 204 to reduce slippage. Also, while FIGS. 3A and 3B show drive rollers 246, 247 to have substantially cylindrical outer surfaces, drive rollers 246, 247 may have any shape that may assist in the movement of line 204, including shapes that contour line 204. In other embodiments, drive rollers 246, 247 of the drive assembly may be replaced with spherical balls, tracks or other rotatable members able to move line 204.

Line 204 may pass through line motivator tool 208, or indeed downhole line tool assembly 200, in a variety of ways. In the illustrated embodiment, a longitudinal side 262 of line motivator tool housing 244 includes an aperture 210, and a downhole end portion 264 of line motivator tool housing 244 includes an aperture 212. In this embodiment, line 204 passes and is moveable through aperture 210 and aperture 212, as well as through internal cavity 214 of line motivator tool housing 244. In another embodiment, aperture 210 may be located at or near an uphole end portion 265 of downhole line tool assembly 200.

A portion of moveable shaft 240 extends into internal cavity 214 of line motivator tool 208, as shown in FIGS. 3A and 3B. In an alternate embodiment, the drive assembly of line motivator tool 208 may contain a drive shaft that is separate from moveable shaft 240, wherein moveable shaft 240 and the drive shaft may be operably associated with one another by either a direct coupling or an indirect coupling, such as via a gearbox. In this embodiment, the drive shaft may have a first end that is operably associated with moveable shaft 240 via the gearbox, and the drive shaft may also have a second, or downhole end that is operably associated with one or more of the drive rollers 246, 247. The gearbox may contain one or more gears that operably associates the drive shaft with the moveable shaft of downhole power unit 206, such that when the moveable shaft rotates at a first angular velocity, the drive shaft rotates at a second angular velocity. The first and second angular velocities may be the same or different from one another. Thus, in this embodiment, when the moveable shaft rotates due to forces applied by downhole power unit 206, the drive shaft also rotate at the same or different angular velocity as moveable shaft 240 to rotate drive rollers 246, 247 and move line 204 in a particular direction 250 or 251.

In operation, downhole line tool assembly 200 is positioned on line 204 and disposed within the wellbore. Moveable shaft 240 is activated to rotate. In response to moveable shaft 240 being activated, drive rollers 246, 247 rotate, which in turn causes line 204 to move in a particular direction 250, 251. In response to drive rollers 246, 247 rotating to move line 204 relative to line motivator tool 208, downhole line tool assembly 200 moves along line 204 through the wellbore.

In an example in which a downhole tool (e.g., line cutter, paraffin scraper, communication module, etc.) is provided and operably associated with either or both of downhole power unit 206 or line motivator tool 208, moveable shaft 240 may be activated to rotate to cause downhole line tool assembly 200 to move along line 204 through the wellbore. When desired, moveable shaft 240, in response to a command from a sensor, a user, or otherwise, may be deactivated to stop downhole line tool assembly 200 from moving through the wellbore, thereby stopping downhole line tool assembly 200 at a target location within the wellbore. The downhole tool may then be activated to perform an operation at the target location within the wellbore. Non-limiting examples of downhole tools, and the types of operations they may perform, have been provided above.

Figure 4A:
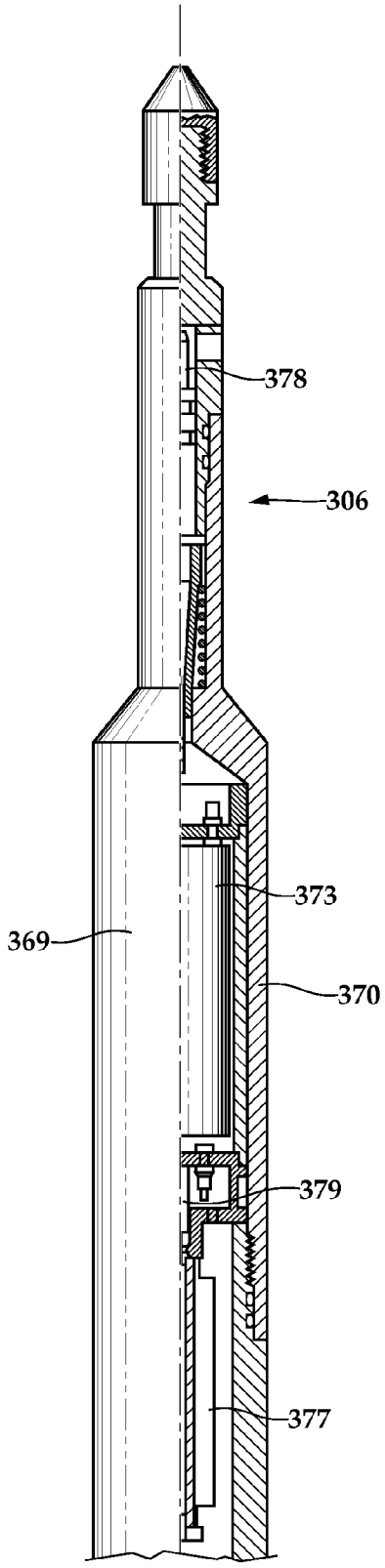
FIGS. 4A and 4B are quarter sectional views of successive axial sections of a downhole power unit for use in a downhole line tool assembly according to an embodiment of the present invention.
Figure 4B:
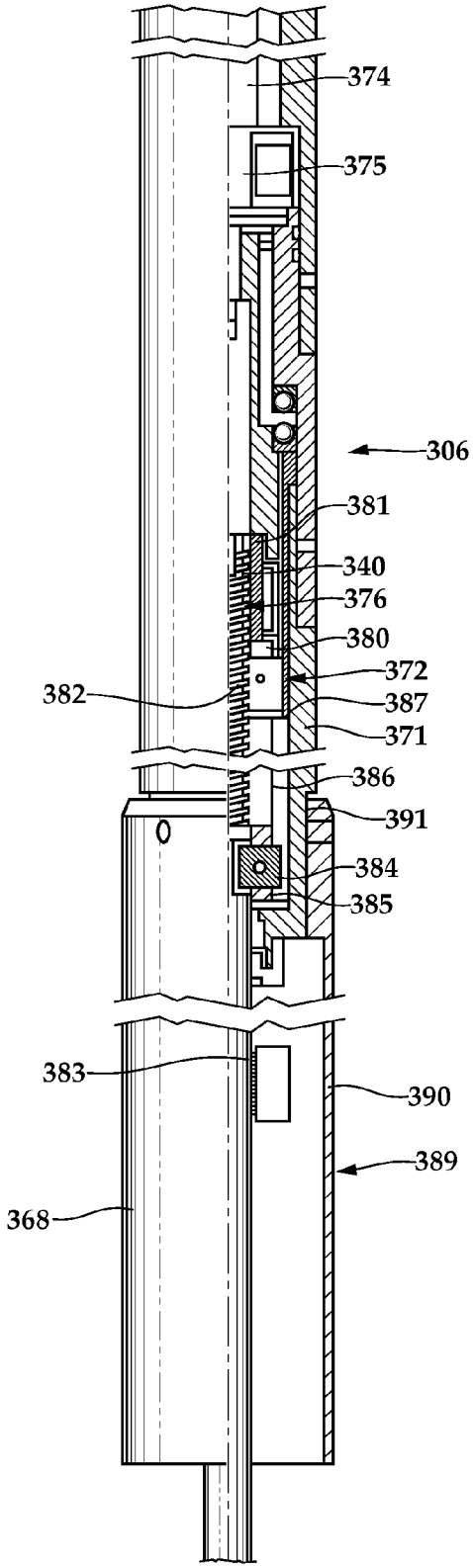

Referring now to FIGS. 4A and 4B, therein are depicted successive axial sections of an illustrative embodiment of downhole power unit 306, which is capable of operations in conjunction with the downhole line tool assemblies of the illustrative embodiments. Elements of FIGS. 4A and 4B that are analogous to elements in FIGS. 3A and 3B have been shown by indexing the reference numerals by 100. Downhole power unit 306 includes a working assembly 368 and a power assembly 369. Power assembly 369 includes a housing assembly 370 which comprises suitably shaped and connected generally tubular housing members. Housing assembly 370 includes a clutch housing 371 as will be described in more detail below, which forms a portion of a clutch assembly 372. In the illustrated embodiment, power assembly 369 includes a self-contained power source depicted as a battery assembly 373 which may include a plurality of batteries such as alkaline batteries, lithium batteries or the like.

Connected with power assembly 369 is a force generating and transmitting assembly. The force generating and transmitting assembly of this implementation may include a direct current (DC) electric motor 374, coupled through a gearbox 375, to a jackscrew assembly 376. A plurality of activation mechanisms 377, 378 and 379, as will be described, may be electrically coupled between battery assembly 373 and electric motor 374. Electric motor 374 may be of any suitable type. One non-limiting example is a motor operating at 7500 revolutions per minute (rpm) in an unloaded condition, and operating at approximately 5000 rpm in a loaded condition, and having a horsepower rating of approximately 1/30th of a horsepower. In this implementation, motor 374 may be coupled through gearbox 375 which may provide approximately 5000:1 gear reduction. Gearbox 375 may be coupled through a conventional drive assembly 380 to jackscrew assembly 376.

Jackscrew assembly 376 includes moveable shaft 340, which may rotate, move longitudinally, or both, in response to rotation of a sleeve assembly 381. Moveable shaft 340 includes a threaded portion 382, and a generally smooth, polished lower extension 383. In one embodiment, lower extension 383 may extend into the line motivator tool. In the illustrated embodiment, moveable shaft 340 includes a pair of generally diametrically opposed keys 384 that cooperate with a clutch block 385 which is coupled to moveable shaft 340. Clutch housing 371 may include a pair of diametrically opposed keyways 386 which extend along at least a portion of the possible length of travel. Keys 384 extend radially outward from moveable shaft 340 through clutch block 385 to engage each of the keyways 386 in clutch housing 371, thereby selectively allowing or preventing rotation of moveable shaft 340 relative to housing 371.

In certain configurations, rotation of sleeve assembly 381 in one direction causes moveable shaft 340 and clutch block 385 to move longitudinally upwardly relative to housing 371 and rotation of sleeve assembly 381 in the opposite direction causes moveable shaft 340 to move longitudinally downwardly relative to clutch housing 371. In other configurations, such as when clutch block 385 is positioned above level 387 and outwardly extending key 384 is free to rotate, rotation of sleeve assembly 381 results in rotation of moveable shaft 340. In certain embodiments, moveable shaft 340 may be restricted to only rotational movement in either direction.

In an illustrative embodiment, downhole power unit 306 may incorporate discrete activation assemblies, separate from or part of the microcontroller discussed above. The activation assemblies enable jackscrew 376 to operate upon the occurrence of one or more predetermined conditions. One depicted activation assembly is timing circuitry 377 of a type known in the art. Timing circuitry 377 may be adapted to provide a signal to the microcontroller after passage of a predetermined amount of time. Further, downhole power unit 306 may include an activation assembly including a pressure-sensitive switch 378 of a type generally known in the art which will provide control signals when, for example, switch 378 experiences a particular pressure variation or series of pressure variations. Still further, downhole power unit 306 may include a motion sensor 379, such as an accelerometer or a geophone, which is sensitive to motion of downhole power unit 306. Accelerometer 379 may be combined with timing circuitry 377 such that when motion is detected or not detected by accelerometer 379, timing circuitry 377 is reset.

Working assembly 368 includes an actuation assembly 389 which is coupled through housing assembly 370 to be moveable therewith. Actuation assembly 389 includes an outer sleeve member 390 which is threadably coupled at 391 to housing assembly 370. Moveable shaft 340 extends through actuation assembly 389 and is adapted to be operably associated with the drive assembly of a line motivator tool.

Figure 5B:
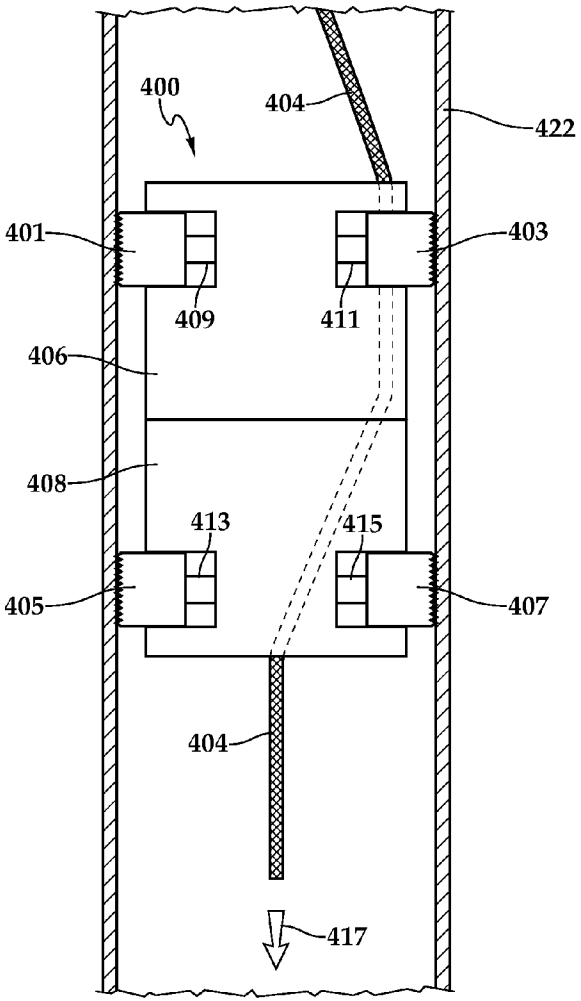
FIGS. 5A and 5B are schematic diagrams of a downhole line tool assembly having anchors in retracted and extended positions, respectively, according to an embodiment of the present invention.
Figure 5A:
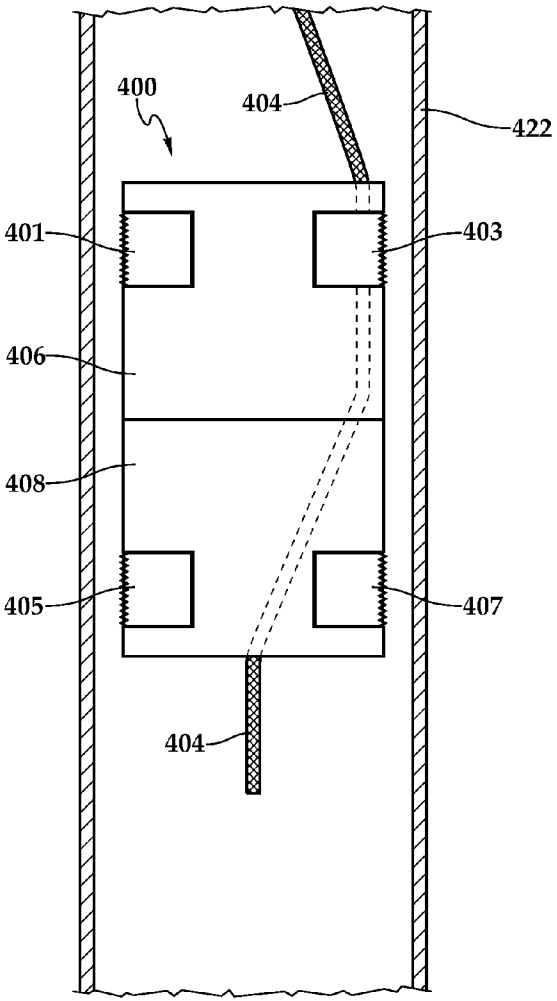

Referring to FIGS. 5A and 5B, an illustrative embodiment of the downhole line tool assembly is generally designated 400. Downhole line tool assembly 400 includes one or more anchors 401, 403, 405, 407. Anchors 401, 403, 405, 407 may be retracted radially inward as shown in FIG. 5A, or may be extended radially outward as shown in FIG. 5B. In the non-limiting example of FIGS. 5A and 5B, anchors 401 and 403 are operably associated with downhole power unit 406 and anchors 405 and 407 are operably associated with line motivator tool 408. Even though a particular number and arrangement of anchors has been depicted and described, it should be understood by those skilled in the art that other anchor systems having other numbers of anchors, both less than and greater than that shown, as well as other types of anchors, including an anchor tool that is independent of but operably associated with either downhole power unit 406 or line motivator tool 408 or both are possible and are considered to be within the scope of the present invention.

When anchors 401, 403, 405, 407 are in the retracted position, as shown in FIG. 5A, anchors 401, 403, 405, 407 are pulled radially inward within downhole line tool assembly 400 so that anchors 401, 403, 405, 407 do not contact the inner surface of tubing string 422. As shown in FIG. 5B, anchors 401, 403, 405, 407 may be extended radially outward from downhole line tool assembly 400 to contact the surface of tubular string 422 so that downhole line tool assembly 400 is secured at a desired location within the wellbore. In one embodiment, each of the anchors 401, 403, 405, 407 may be extended radially outward by a respective extender 409, 411, 413, 415. Extenders 409, 411, 413, 415 may be employed in response to a command to set anchors 401, 403, 405, 407, respectively. Extenders 409, 411, 413, 415 may also be used to retract anchors 401, 403, 405, 407 back radially inward toward downhole line tool assembly 400 upon command. Extenders 409, 411, 413, 415 may operate mechanically, electrically, hydraulically or the like. Anchors 401, 403, 405, 407 and/or extenders 409, 411, 413, 415 may be powered by the power source within downhole power unit 406 or from another power source.

Anchors 401, 403, 405, 407 may include components capable of establishing a gripping relationship with the inner surface of tubular string 422, such as metal slips, rubber elements or other members having the ability to grip against the inner surface of tubular string 422. Anchors 401, 403, 405, 407 may have any shape that facilitates the anchoring of downhole line tool assembly 400 in the wellbore at a target location. Once anchors 401, 403, 405, 407 have been extended to secure downhole line tool assembly 400 within the wellbore, downhole line tool assembly 400 may be used to move line 404 either uphole or downhole through the wellbore. For example, as shown in FIG. 5B, after downhole line tool assembly 400 has been secured within the wellbore, the moveable shaft of downhole power unit 406 may be rotated to cause the drive assembly of line motivator tool 408 to push line 404 downhole in the direction indicated by arrow 417.

As described above, the moveable shaft of downhole power unit 406 may be rotated in a first direction or a second, opposite direction. When the moveable shaft is rotated in the first direction while anchors 401, 403, 405, 407 have been extended, the drive assembly of line motivator tool 408 rotate, as described above, to move line 404 downhole through the wellbore. Conversely, when the moveable shaft is rotated in the second direction, the drive assembly likewise rotates in an opposite direction to pull line 404 uphole.

In operation, while anchors 401, 403, 405, 407 are refracted, line 404 may be utilized by downhole line tool assembly 400 to shuttle through the wellbore in order to reach a target location. Such utilization of line 404 to shuttle through the wellbore has been described above. Once downhole line tool assembly 400 has reached the target location, anchors 401, 403, 405, 407 may be extended to secure downhole line tool assembly 400 within the wellbore at that target location. Then the moveable shaft may be rotated by downhole power unit 406 to move line 404 either downhole or uphole.

Figure 6:
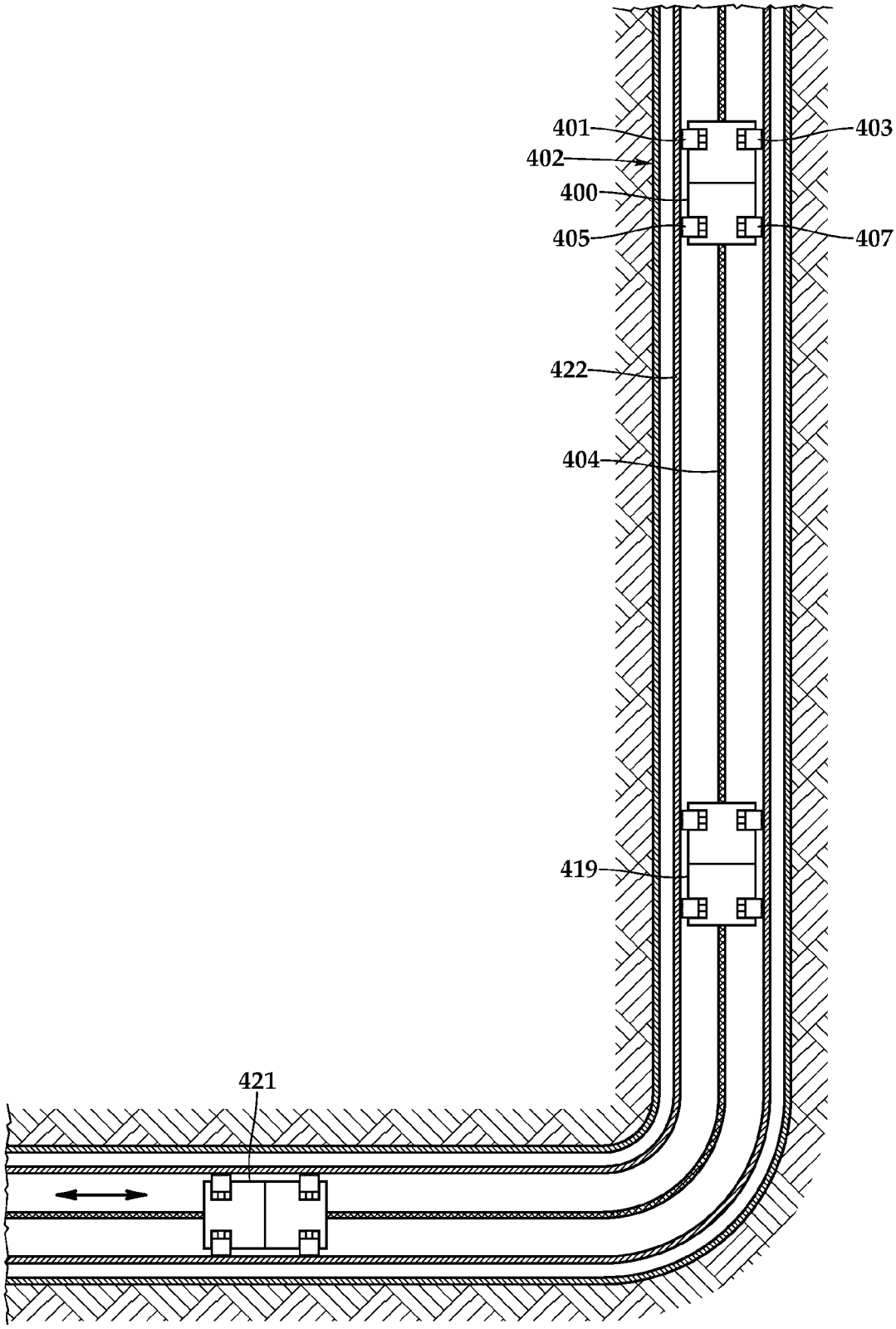
FIG. 6 is a schematic illustration of a well system having multiple downhole line tool assemblies deployed therein according to an embodiment of the present invention.

Referring specifically to FIG. 6, more than one downhole line tool assembly may be used in a wellbore 402 to move line 404 downhole or uphole, depending on the application. In particular, downhole line tool assemblies 419 and 421 may also be deployed in wellbore 402. In one embodiment, multiple downhole line tool assemblies 400, 419, 421 may be used to extend line 404 deeper within wellbore 402 than would have been achievable using only gravity or only a single downhole line tool assembly 400. It will also be appreciated that the multiple downhole line tool assemblies 400, 419, 421 may be used to extend or retract line 404 through wellbore 402 having both favorable and unfavorable directional characteristic such as the vertical and horizontal portions shown in FIG. 6, respectively.

Downhole line tool assemblies 400, 419, 421 may each use line 404 to shuttle to various target locations, such as those shown in FIG. 6, and then anchor themselves at the target locations where they may perform the function of pushing line 404 downhole or uphole. After moving line 404, downhole line tool assemblies 400, 419, 421 may change their respective target locations as necessary to facilitate further movement of line 404. Downhole line tool assemblies 400, 419, 421 may also be used to retract line 404 back uphole.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole line tool assembly for use in a wellbore, the downhole line tool assembly comprising:

a downhole power unit having a moveable shaft;

a line motivator tool having a drive assembly adapted to contact a line passing through the line motivator tool in the wellbore, the drive assembly operably associated with the moveable shaft such that rotation of the moveable shaft rotates the drive assembly, thereby moving the line relative to the line motivator tool; and an anchor assembly operably associated with at least one of the downhole power unit and the line motivator tool, the anchor assembly extendable radially outward from the downhole line tool assembly to contact a surface within the wellbore to secure the downhole line tool assembly at a target location within the wellbore, wherein, rotation of the moveable shaft in a first direction moves the line uphole relative to the downhole line tool assembly and the wellbore and rotation of the moveable shaft in a second direction moves the line downhole relative to the downhole line tool assembly and the wellbore when the downhole line tool assembly is secured at the target location.

2. The downhole line tool assembly as recited in claim 1 wherein the downhole line tool assembly is operable to move along the line through the wellbore when the drive assembly moves the line relative to the line motivator tool and the downhole line tool assembly is not secured at the target location.

3. The downhole line tool assembly as recited in claim 2 wherein rotation of the moveable shaft in the first direction moves the line motivator tool downhole relative to the line and the wellbore and rotation of the moveable shaft in the second direction moves the line motivator tool uphole relative to the line and the wellbore when the downhole line tool assembly is not secured at the target location.

4. The downhole line tool assembly as recited in claim 1 further comprising a first downhole tool operably associated with at least one of the downhole power unit and the line motivator tool.

5. The downhole line tool assembly as recited in claim 4 wherein the first downhole tool further comprises a line cutter.

6. The downhole line tool assembly as recited in claim 4 wherein the first downhole tool further comprises a paraffin scraper.

7. The downhole line tool assembly as recited in claim 4 wherein the first downhole tool further comprises a communication module operable to communicate with a second downhole tool.

8. The downhole line tool assembly as recited in claim 7 wherein the communication module is operable for wirelessly communications.

9. The downhole line tool assembly as recited in claim 7 wherein the communication module is operable to couple to the second downhole tool to enable communication therebetween.

10. The downhole line tool assembly as recited in claim 1 wherein the line further comprises a slickline.

11. The downhole line tool assembly as recited in claim 1 wherein the line motivator tool further comprises a housing having first and second apertures and defining an internal cavity and wherein the line is moveable through the first aperture, the second aperture and the internal cavity.

12. The downhole line tool assembly as recited in claim 1 wherein the drive assembly further comprises first and second drive rollers operable to receive the line therebetween.

13. The downhole line tool assembly as recited in claim 1 wherein the drive assembly further comprises a drive shaft and a gearbox operably associated with the moveable shaft.

14. The downhole line tool assembly as recited in claim 1 wherein the downhole power unit further comprises a self-contained power source for providing electrical power.

15. The downhole line tool assembly as recited in claim 1 wherein the downhole power unit further comprises:

an electric motor comprising a rotor; and a jackscrew assembly comprising a rotational member connected to the rotor, the rotational member operably associated with the moveable shaft to impart motion to the moveable shaft.

16. A method for operating a downhole line tool assembly in a wellbore, the method comprising:

providing a downhole line tool assembly including a downhole power unit having a moveable shaft and a line motivator tool having a drive assembly adapted to contact a line passing through the line motivator tool in the wellbore;

operably associating the drive assembly with the moveable shaft such that rotation of the moveable shaft rotates the drive assembly;

responsive to rotation of the drive assembly, moving the line relative to the line motivator tool in the wellbore;

anchoring the downhole line tool assembly in the wellbore;

moving the line uphole relative to the downhole line tool assembly and the wellbore responsive to rotation of the moveable shaft in a first direction; and moving the line downhole relative to the downhole line tool assembly and the wellbore responsive to rotation of the moveable shaft in a second direction.

17. The method as recited in claim 16 further comprising moving the line motivator tool downhole relative to the line and the wellbore responsive to rotation of the moveable shaft in the first direction and moving the line motivator tool uphole relative to the line and the wellbore responsive to rotation of the moveable shaft in the second direction when the downhole line tool assembly is not anchored in the wellbore.

18. The method as recited in claim 16 further comprising:

providing a downhole tool operably associated with at least one of the downhole power unit and the line motivator tool;

rotating the moveable shaft to position the downhole line tool assembly at a target location within the wellbore; and activating the downhole tool to perform an operation within the wellbore.

* * * * *